US006611986B1

(12) United States Patent
Seals

(10) Patent No.: US 6,611,986 B1
(45) Date of Patent: Sep. 2, 2003

(54) DISPOSABLE CLEANING PAD DISPENSER

(76) Inventor: Valerie Seals, 9 Pheasent Dr., West Nyack, NY (US) 10994

( * ) Notice: Subject to any disclaimer, the term of this patent is extended or adjusted under 35 U.S.C. 154(b) by 0 days.

(21) Appl. No.: 09/920,992

(22) Filed: Aug. 1, 2001

Related U.S. Application Data

(60) Provisional application No. 60/222,634, filed on Aug. 3, 2000.

(51) Int. Cl.[7] ..... A47L 13/46
(52) U.S. Cl. ..... 15/210.1; 294/19.1
(58) Field of Search ..... 15/210.1, 229.13, 15/231; 294/19.1, 19.2

(56) References Cited

U.S. PATENT DOCUMENTS 2,249,727 A * 7/1941 Butler
2,648,085 A * 8/1953 Rodgers
2,666,224 A * 1/1954 Adams
3,031,683 A * 5/1962 Hellwig
3,223,096 A * 12/1965 Goldberg et al.
4,031,673 A * 6/1977 Hagelberg
4,053,242 A * 10/1977 Mast
4,987,634 A * 1/1991 Weihrauch
5,092,013 A * 3/1992 Genovese
5,323,507 A * 6/1994 Tosato
5,630,243 A * 5/1997 Federico et al.
6,094,771 A * 8/2000 Egolf et al.

* cited by examiner

*Primary Examiner*—Terrence R. Till
(74) *Attorney, Agent, or Firm*—Michael E. Zall

(57) ABSTRACT

This invention is directed to a disposable cleaning pad dispenser system. The system comprises a pad dispenser having an elongated member with a chamber therein. The chamber is surrounded by side walls and has an open top that optionally has a closure. A plurality of disposable cleaning pads are stacked one upon the other to form an elongated column. The column is of a size and shape that fits through the open top and fits within the chamber. The sides of the so formed column may slidably engage the side walls of the chamber.

A cleaning wand is provided. The wand includes a hollow cylindrical member that has a near end and a distal end. An end plate is mounted to the open distal end, the end plate being substantially the same size and shape as the disposable cleaning pad, and slidably engageable with the side walls of the chamber of the dispenser. The wand further comprises a rod having a near end and distal end slidably mounted within the cylindrical member. The wand has a spring biased piston attached to the near end of the rod. The piston is slidably mounted within the open near end of the cylindrical member. The rod has a plurality of fingers for gripping a cleaning pad attached to the distal end thereof. When the piston is depressed, the fingers slidably extend from the distal end of the hollow cylindrical member to project below the end plate. When the piston member is released and there is the spring biased return of the piston to its original position, the fingers slidably retract into the distal end of the hollow cylindrical member. The fingers are spring biased to open when extended from the distal end of the cylindrical member.

In use, when the distal end of the wand is placed through the open top of the pad dispenser, the end plate slidably engages the side walls. The piston is then depressed and the fingers extend from the distal end of the cylindrical member and below the end plate. The fingers are then placed against the top most cleaning pad and the piston released. The fingers then close to grip the cleaning pad and maintain the pad substantially flat and coextensive against the bottom of the support plate. The pad is then used to clean, for example, toilet surfaces.

9 Claims, 5 Drawing Sheets

DISPOSABLE CLEANING PAD DISPENSER

RELATED APPLICATIONS

This application claims the benefit of Provisional Application U.S. Ser. No. 60/222,634 filed on Aug. 3, 2000, the entire disclosure of which is incorporated herein by reference.

BACKGROUND OF THE INVENTION

1. Field of the Invention

This invention relates to devices and systems for cleaning toilet bowls and other type surfaces having complex curves and which are generally unsanitary or unsafe to touch.

2. Prior Art

There are many devices known for cleaning surfaces, and in particular toilet bowls. Generally these surfaces are unsanitary and difficult to reach. Often special cleaning chemicals are required to clean such surfaces, e.g., soaps, disinfectants, etc. It is thus undesirable for persons to touch these chemicals and/or touch the surfaces being cleaned.

Applicant is aware of the following US Patents which may be considered relevant to the invention described herein:

U.S. Pat. No. 5,642,913 to Brown describes a tool for contacting a surface with a treating material without direct personal contact of either the surface treated or the treating material. The tool comprises a hollow cylindrical sleeve containing a spring-biased, expandable claw which, upon manual operation of a plunger attached to the claw, grasps, holds and releases the treating material.

U.S. Pat. No. 5,630,243 to Federico et al describes a toilet cleaning device. The device is a plastic tool with a handle and trigger at one end and a pair of jaws (one of which is moveable) at the other end. The jaws are inserted into a biodegradable paper cleaning pad filled with cleaning/disinfectant and/or deodorant materials. The lower jaw is moveable by way of a trigger near the handle. When depressed the trigger compresses a lock spring and moves an actuator rod down the barrel which operates a hinge to open the jaws. The open jaws can surround a cleaning pad and upon the release of the trigger the coil operating spring decompresses and moves the actuator rod back toward the handle locking the jaws over the center tab of the cleaning pad. The device has a 15-degree bend in the barrel to facilitate cleaning toilet bowls. The soiled and used cleaning pad is disposed of by pointing the tools toward the toilet bowl and squeezing the trigger which causes the jaws to open and permits the used cleaning pad to drop into the toilet bowl to be flushed away.

U.S. Pat. No. 5,092,013 to Genovese, Jr. describes a disposable toilet seat wipe apparatus that includes a premoistened, cleansing pad within a carrying container in coupling relationship with a plunger construction extending outwardly from one of the container ends. The opposite end of the container is configured to "blossom" the cleansing pad out of the container as the plunger is actuated inwardly. The plunger and container then serve as a handle for the apparatus in wiping the seat with the premoistened pad so deployed. A series of protrusions are also provided within the container to prevent the cleansing pad from coming loose from the handle during manipulation of the apparatus.

U.S. Pat. No. 4,987,634 to Weihrauch describes a tool for cleaning or treating surfaces. The tool has a holder and a deformable disposable pad interchangeably gripped by it. The holder includes a sleeve constructed as a stick or grip and a sliding part guided thereon with a handle on one end projecting over the sleeve. Grippers, which can be opened and closed, are at the other end.

U.S. Pat. No. 4,971,222 to Rohde et at describes an apparatus for storing and individually dispensing coffee machine filters. The apparatus is of cylindrical construction with a resilient dispensing type applicator insertable in the cylinder to permit a coffee filter to be removed. A bottom, upwardly protruding base member is provided in the cylindrical interior to contact the reverse side of a stack of coffee machine filters. The apparatus has a manually operable applicator with a plurality of spring arms to compress against the stack of coffee filters while frictionally engaging the upwardmost filter of said filters. The applicator has extension arms with curved end portions for guiding the arms upon the surface of the upwardmost coffee filter and further has the coarse, tacky interior surface for frictionally engaging upon the upward surface of the filters.

U.S. Pat. No. 3,101,500 to Paolantonio describes a mop for cleaning floors adapted to employ paper towels from dispensing rolls, as swabs, without necessity for attachment, and adapted to pick up the towels after use, for disposal, without contact by the human hand.

U.S. Pat. No. 2,947,564 to Winther describes a mechanics' tool having a spring clip for picking up and inspecting parts in inaccessible places.

U.S. Pat. No. 2,752,625 to Ponsell describes a handle with an automatic grip for holding specially prepared pads of steel wool for scrubbing pots and pans.

U.S. Pat. No. 2,320,967 to Dunkelberger describes a flexible mechanical finger gripping device.

OBJECTS AND SUMMARY OF THE INVENTION

It is an object of this invention to provide an inexpensive device for cleaning toilet bowl surfaces and other difficult to reach surfaces with a flat disposable pad containing a cleanser and/or disinfectant or other type chemical thereon.

It is an object of this invention to provide a combination cleaning pad dispenser, cleaning pads and toilet rim and seat cleaner that coacts to provide a system that uses disposable pads which do not have to be handled by the person cleaning the toilet bowl and can be conveniently used and then disposed of.

All of the foregoing objects are achieved by the disposable cleaning pad dispenser system of this invention. The system comprises a pad dispenser having an elongated member with a chamber therein. The chamber is surrounded by side walls and has an open top that optionally has a closure.

A plurality of disposable cleaning pads are stacked one upon the other to form an elongated column. The column is of a size and shape that fits through the open top and fits within the chamber of the pad dispenser. The sides of the so formed column may slidably engage the side walls of the chamber.

The system further comprises a cleaning wand having a near end and a distal end. The wand comprises a hollow elongated member having a near end and a distal end and an elongated opening therethrough to thereby form an open near end and an open distal end, e.g., a hollow cylindrical member. An end plate is mounted to the open distal end, the end plate being substantially the same size and shape as the disposable cleaning pad, and slidably engageable with the side walls of the chamber of the dispenser. The wand further comprises a rod having a near end and distal end slidably mounted within the cylindrical member.

The wand has a spring biased piston attached to the near end of the rod. The piston that is slidably mounted within the open near end of the cylindrical member. The rod has a plurality of fingers for gripping a cleaning pad attached to the distal end thereof. When the piston is depressed, the fingers slidably extend from the distal end of the hollow cylindrical member to project below the end plate. When the piston member is released and there is the spring biased return of the piston to its original position, the fingers slidably retract into the distal end of the hollow cylindrical member. The fingers are spring biased to open when extended from the distal end of the cylindrical member.

Thus, when the distal end of the wand is placed through the open top of the pad dispenser, the end plate slidably engages the side walls. When the piston is depressed, the fingers extend from the distal end of the cylindrical member and below the end plate. The fingers are then placed against the top most cleaning pad and the piston released. The fingers then close to grip the cleaning pad and maintain the pad substantially flat and coextensive against the bottom of the support plate. The pad is then used to clean, for example, toilet surfaces.

DETAILED DESCRIPTION OF THE PREFERRED EMBODIMENTS

Figure 1:
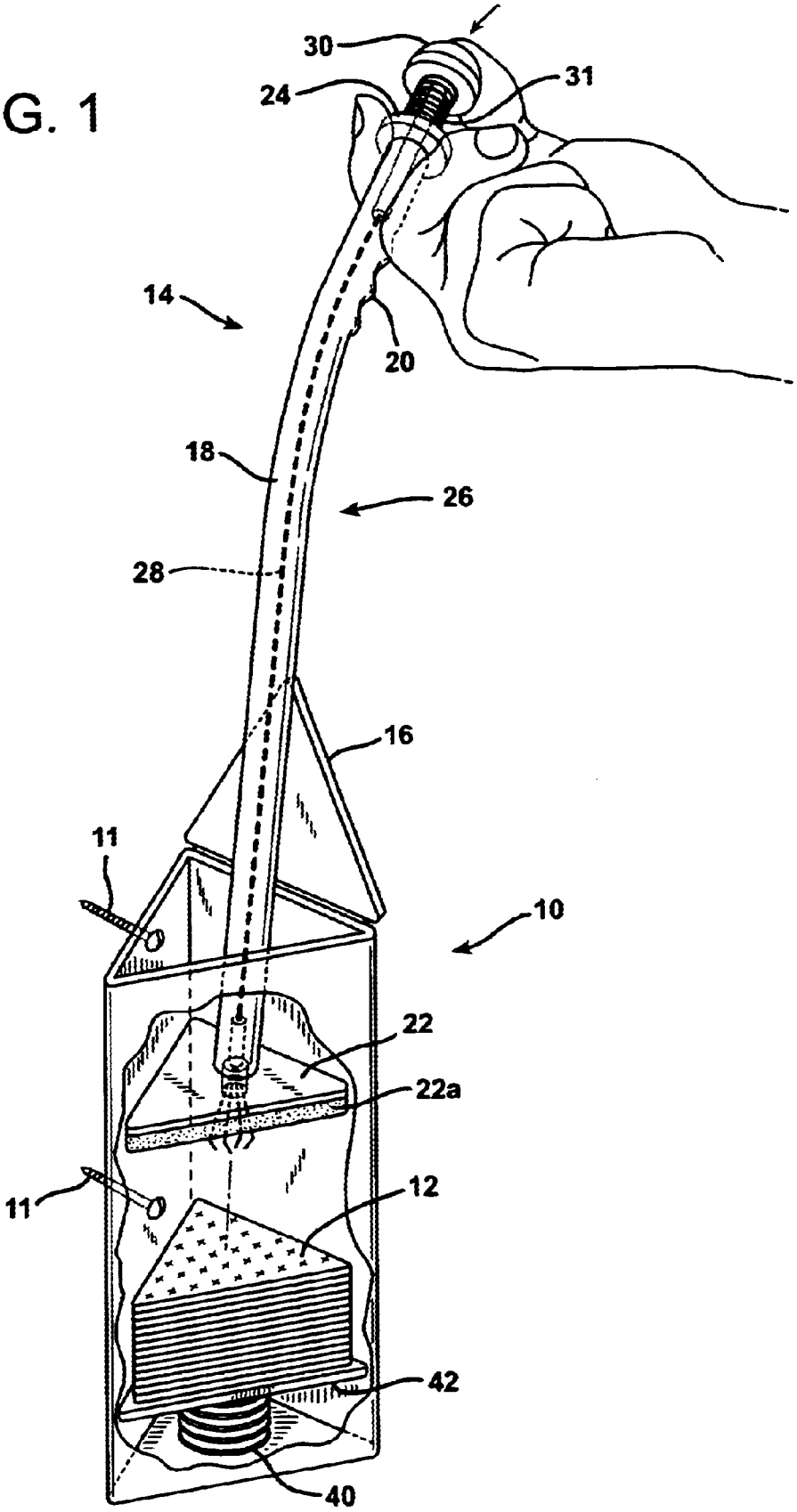
FIG. 1 is a perspective view of an embodiment of the disposable cleaning pad dispenser system of this invention comprising disposable cleaning pads, a dispenser for such pads and a means for gripping and using such pads for cleaning.
Figure 2:
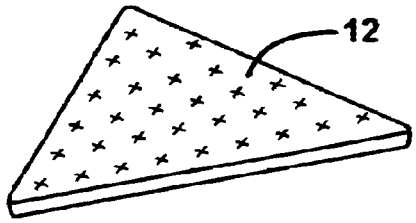
FIGS. 2 and 2A are perspective views of an embodiment of a disposable cleaning pad used in the system of this invention shown in FIG. 1.
Figure 2A:
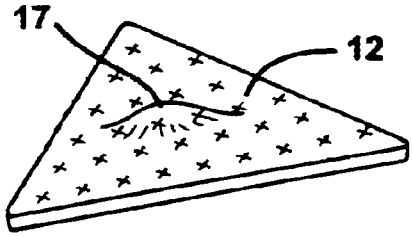
Figure 2B:
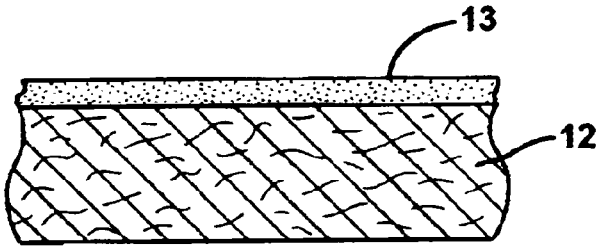
FIG. 2B is an enlarged sectional view of the disposable cleaning pad shown in FIGS. 2 and 2A.
Figure 5:
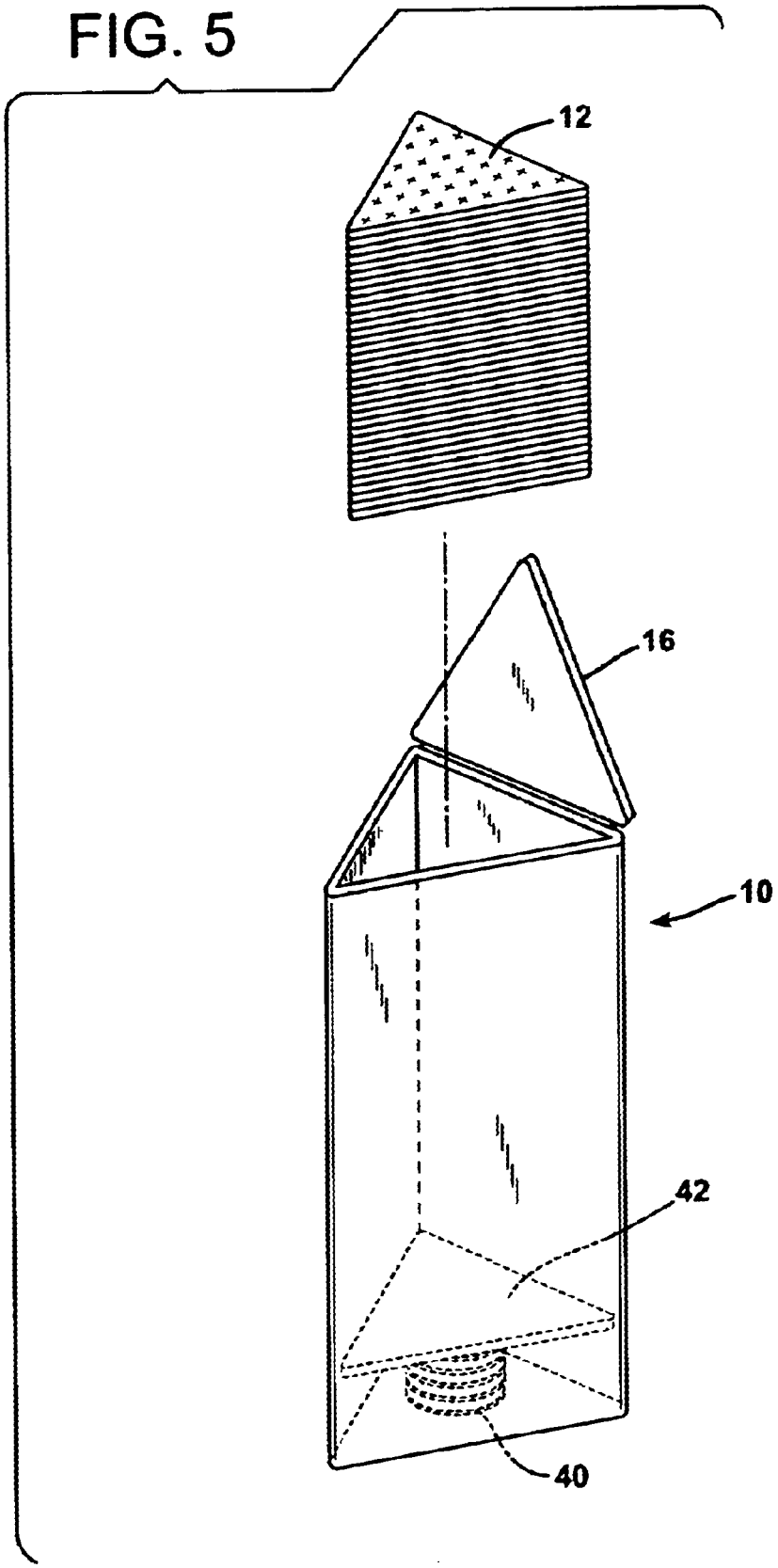
FIG. 5 is a schematic perspective view of a cleaning pad dispenser and a stack of cleaning pads used in the system of this invention.

Referring to the drawings, wherein like reference characters designate like or corresponding parts throughout the views, FIGS. 1 and 5 show a dispenser or container 10, preferably made of plastic, that contains therein the cleaning pads 12. As shown in the FIGS. 1–3 and 5, in the preferred embodiment of the system the pads 12 are triangular. As shown in FIG. 2B, the top of the pad may optionally have a coating or layer 13 made of, for example, a polymeric type material, that permits the pad to be gripped and easily separated from the gripper when disposed of. Optionally, as shown in FIG. 2A, the pad 12 can have a slight protrusion 17 to permit the easy gripping of the pad 12 by the cleaning wand, generally 14. The pads 12 are preferably saturated with a disinfectant or cleaning chemical.

Referring to FIGS. 1 and 5, the container 10 is designed to enclose a plurality of pads 12 stacked therein. Preferably, the container 10 is an elongated triangular container that includes a base 41, sides, generally 44 and a top 16 hingedly attached to the top of the container 10. The pads 12 are designed to be stacked upon each other and to be easily and slidably inserted and removed from the container 10. The pads 12 and container 10 , in the preferred embodiment are triangular. However this invention contemplates any practical shape, e.g., round, square, triangular, octagonal, etc., as long as the pads 12 can be slidably inserted and removed from the container 10.

Referring to FIGS. 1 and 5, on the base 41 is a spring 40 and above such spring 40 and slidably mounted within the container 10 is a pad support plate 42. The spring 40 and pad support plate 42 provide spring resistance as the gripper mechanism 26 within the cleaning wand 14 grabs the top of a pad 12 and also raise the pads 12 toward the container 10 opening so that the pad can be easily seen and grabbed by the gripper mechanism 26. As the pads 12 are removed from the container 10, the spring 40 raises a new pad 12 toward the top of the container for gripping. The pads 12 are designed to be easily removed and gripped by the gripper mechanism 26, see FIGS. 1, 3 and 4.

The dispenser or container 10 preferably has a hinged top 16 to protect and enclose the pads 12. The dispenser 10 can have a means for mounting it to the surface of a cabinet door or wall, such as through screw 11 or mounting tape (not shown). The dispenser may also be designed to be free standing so that it can be placed on the floor behind a toilet. It is preferred to mount the dispenser 10 on a wall so that a pad 12 can be gripped by using only one hand. The dispenser can also have a means for securely mounting thereon the cleaning wand 14 when it is not being used (not shown).

Figure 3:
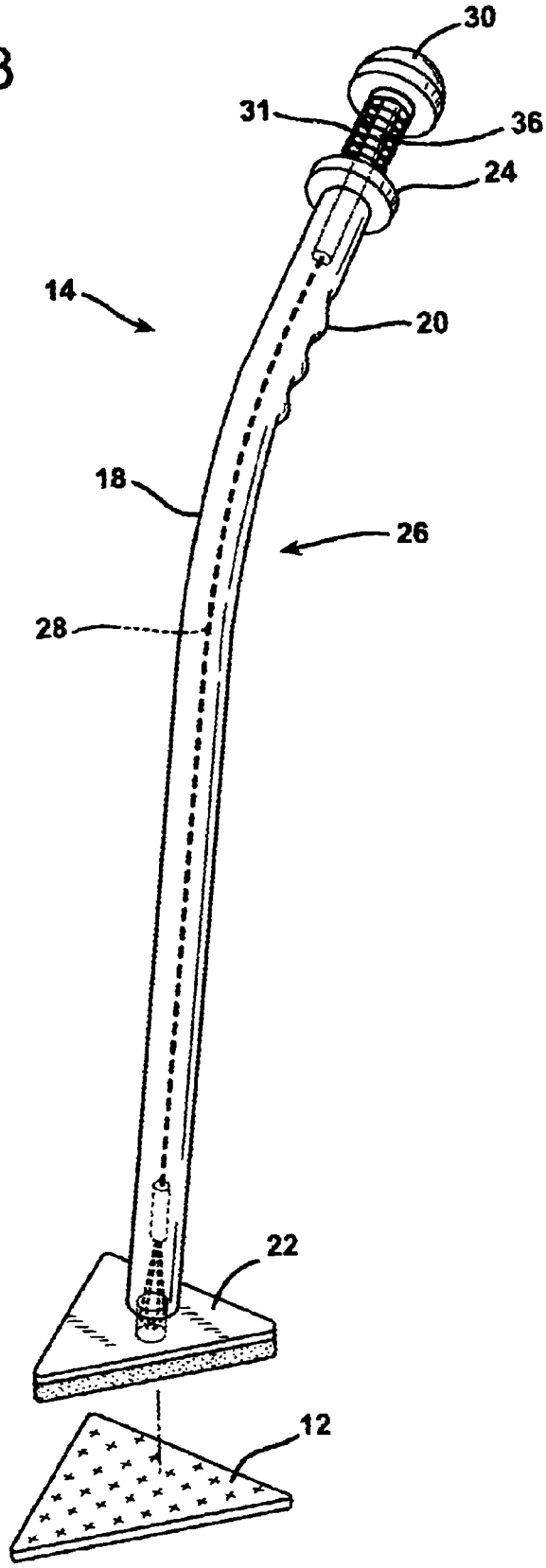
FIG. 3 is a perspective view of an embodiment of the disposable cleaning pads and means for gripping and using such pads shown in FIGS. 1 and 2 herein.
Figure 4:
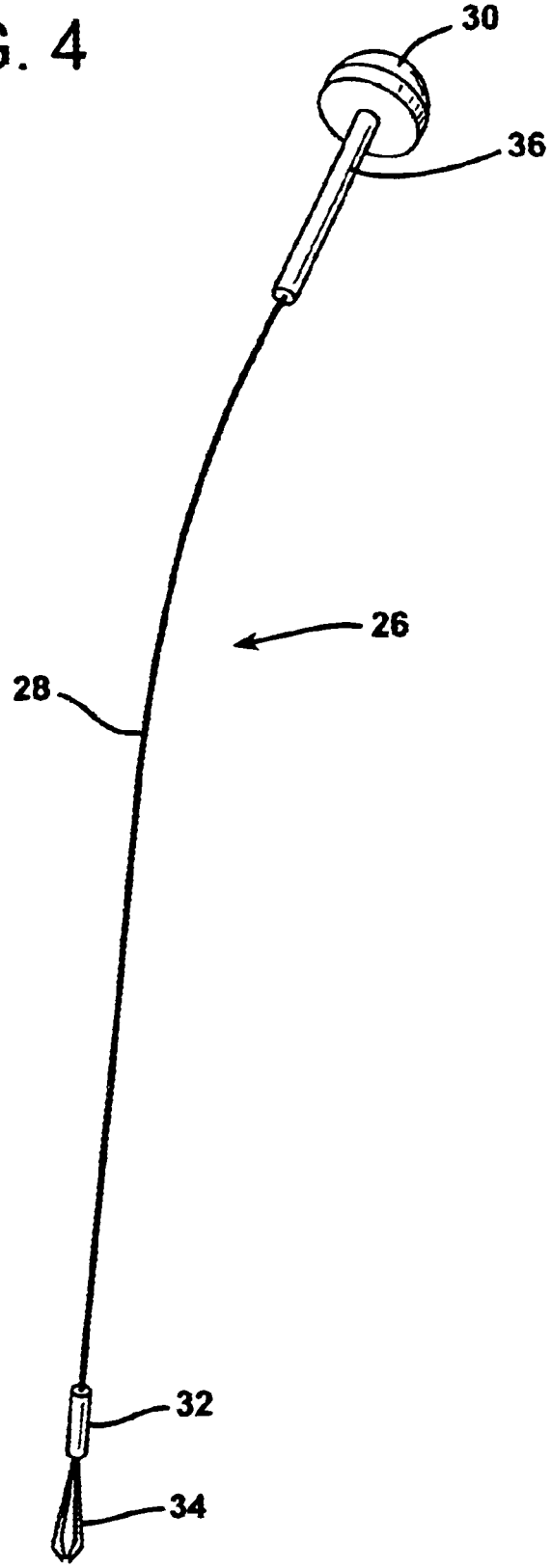
FIG. 4 is a perspective view of an embodiment of the gripper mechanism of the disposable cleaning pad dispenser system used to grip the pad.

Referring to FIGS. 1, 3 and 4, the cleaning wand 14 used in conjunction with the dispenser 10 and pads 12 includes a hollow cylindrical member 18. Preferably the member 18 has a slight curve to it to enable the wand 14 to reach hard to get at places and to make it ergonomically functional. The cylindrical member 18 is preferably made of a plastic material and has molded on the exterior surface thereof, for example, finger nubs or a knurled surface 20 to enable the user to easily grasp the wand 14 .

The hollow cylindrical member 18 has mounted at the distal end an end plate 22 which slidably fits into the top of dispenser 10. In the embodiment depicted herein, the end plate 22 is triangular and substantially the same size and shape as the pad 12 and the interior of the dispenser 10. The end plate 22, pad 12 and interior of the dispenser 10 are shown to be the same shapes and substantially the same sizes so that they can matingly engage with each other. Although the end plate 22 is shown and preferred to be substantially the same size and shape as the pad 12, it need not be. All that is required is that the end plate 22 fit within the dispenser 10 and sufficiently support the pad 12 to enable it to be used for its cleaning function.

In the preferred embodiment the end plate 22 includes a sponge or rubber base 22*a* mounted to the lower surface thereof. This enables the end plate 22 and base 22*a* to conform to the curved surfaces being cleaned or wiped, e.g., toilet bowl.

Still referring to FIGS. 1, 3 and 4, mounted at the near end of the cylindrical member 18 is a circular lip 24. This lip 24 in combination with the knurled surface or finger nubs 20 enables the user to conveniently grip and use the cleaning wand 14. Passing through the center of the circular lip 24, hollow cylindrical member 18 and center of the end plate 22, 22*a* is gripping mechanism, generally designated 26.

Referring to FIG. 4, this gripping mechanism 26 comprises a relatively stiff cable or rod 28 having on the near end a piston 30. The cable 28 passes through the hollow cylindrical member 18. The piston 30 includes a nub 36 projecting therefrom that passes through and slidably sets within the near end of the hollow cylindrical member 18. Referring to FIGS. 1 and 3, the piston 30 is spring biased by a helical spring 31 that is mounted on nub 36, and biased between the piston 30 and the circular lip 24 mounted on the near end of the hollow cylindrical member 18. Thus, referring to FIG. 1, when the piston 30 is pushed downward the spring 31 tends to force the cable 28 and piston 30 to the original position.

Referring to FIG. 4, at the far end of the gripping mechanism 26 is a plastic or metal cylindrical casing 32 surrounding and slidably mounted to the cable 28. This casing 32 is slidably mounted within hollow cylindrical member 18. This casing 32 maintains and guides the cable 28 within the hollow cylindrical member 18 so that when activated by pushing and releasing the piston 30, the cable 28 smoothly slides within the member 18.

Attached to the far end of the cable 28 are gripping fingers 34, preferably four, which are spring biased to open. These gripping fingers 34 project from the center of the end plate 22 and rubber base 22*a* and are open when the cable 28 is moved toward the far end by forcing the piston 30 downward. When the piston 30 is released the spring 31 biases the piston 30 upward, drawing the cable 28 with it. The gripping fingers 34 are drawn toward an opening or hole in the center of the end plate 22 and rubber base 22*a* and are forced by the walls of the opening or hole to close, enabling the gripping fingers 34 to grip the top of a cleaning pad 12.

In use, the wand 18 is gripped with one hand (two hands are not needed to operate the device), the thumb depressing the piston 30. This forces the cable downward causing the spring 31 to bias upwardly. As the piston 30 is pushed downward, it forces the gripping fingers 34 to pass through the end plate 22, 22*a* and spread apart. The end plate 22, 22*a* is then placed into the top of container 10 and placed against the top of the uppermost pad 12. The piston 30 is then released, causing the gripping fingers 34 to retract and to close as they pass through the opening in the bottom plate 22, 22*a*. As this is happening, the gripping fingers 34 grip the top of the pad 12 and hold it against the bottom of rubber plate 22*a*. The person then uses the wand 18 to guide the retained pad 12 against the surface being wiped or cleaned. After use, the circular piston 30 is again pushed downward, forcing the gripping fingers 34 to pass through the end plate 22, 22*a*, spread apart and release the pad 12 for disposal.

Preferably the system of this invention is a plastic structure, however various parts of the system may be made of a metal, e.g., stainless steel.

It will be understood that various changes in the details, arrangements and configuration of the parts and assemblies which have been described and illustrated may be made by those skilled in the art within the principle and scope of the present invention.

What is claimed is:

1. A disposable cleaning pad dispenser system comprising:

a pad dispenser comprising an elongated member having a chamber within the member, the chamber surrounded by side walls and having an open top;

a plurality of disposable cleaning pads stacked one upon the other to form an elongated column having a topmost cleaning pad, the column having a size and shape that fits through the open top and fits within the chamber of the pad dispenser;

a cleaning wand having a near end and distal end, the wand comprising:

a hollow elongated member having a near end and a distal end and an elongated opening therethrough to thereby-form an open near end and an open distal end;

an end plate mounted to the open distal end and slidably engageable with the side walls of the chamber;

a rod having a near end and distal end slidably mounted within such elongated opening;

a spring biased piston attached to the near end of the rod and slidably mounted within the open near end of the elongated member;

a plurality fingers for gripping a cleaning pad, the fingers attached to the distal end of the rod;

wherein the fingers are slidably extendable from the distal end of the elongated member when the piston is depressed to project below the end plate and slidably retractable into the distal end of the elongated member upon the spring biased return of the piston member when released; and wherein the fingers are spring biased to open when extended from the distal end of the elongated member;

whereby when the distal end of the wand is placed through the open top of the pad dispenser, the end plate slidably engages the side walls, and when the piston is depressed, the fingers extend from the distal end of the elongated member and below the end plate and when the fingers are placed against the top most cleaning pad and the piston released, the fingers close to grip the cleaning pad and maintain the pad substantially flat against the bottom of the end plate.

2. The system of claim 1, wherein the chamber has a triangular cross-section.

3. The system of claim 1, wherein the pad dispenser further comprises a removable cover for the open top.

4. The system of claim 1, wherein the cleaning pad dispenser further comprises mounting means for mounting the dispenser on a wall.

5. The system of claim 1, wherein the pad comprises a lower layer for cleaning a surface covered by an upper layer adapted to be gripped and coact with the fingers.

6. The system of claim 1, wherein the wand is slightly curved over its length.

7. The system of claim 1, wherein the end plate is substantially the same size and shape as the disposable cleaning pad.

8. The system of claim 7, wherein the column sides formed by the cleaning pads slidably engage the side walls of the chamber.

9. A disposable cleaning pad dispenser system comprising:

a pad dispenser comprising an elongated member having a chamber within the member, the chamber surrounded by side walls and a spring biased bottom wall slidable within the side walls, and having an open top;

a plurality of disposable cleaning pads stacked one upon the other to form an elongated column having a topmost cleaning pad, the column having a size and shape that fits through the open top and fits within the chamber of the pad dispenser, the column sides slidably engaging the side walls of the chamber;

a cleaning wand having a near end and distal end, the wand comprising:

a hollow elongated member having a near end and a distal end and an elongated opening therethrough to thereby form an open near end and an open distal end;

a rod having a near end and distal end slidably mounted within such elongated opening;

a spring biased piston attached to the near end of the rod and slidably mounted within the open near end of the elongated member;

a plurality fingers for gripping a cleaning pad, the fingers attached to the distal end of the rod;

wherein the fingers are slidably extendable from the distal end of the elongated member when the piston is depressed and slidably retractable into the distal end of the elongated member upon the spring biased return of the piston member when released; and wherein the fingers are spring biased to open when extended from the distal end of the elongated member;

whereby when the distal end of the wand is placed through the open top of the pad dispenser and the piston depressed, the fingers extend from the distal end of the elongated member and when the fingers are placed against the top most cleaning pad and the piston released, the fingers close to grab the cleaning pad and the bottom wall raises the uppermost pad to a higher level.

* * * * *